United States Patent [19]

Molitor

[11] Patent Number: 4,617,909

[45] Date of Patent: Oct. 21, 1986

[54] METHOD OF AND DEVICE FOR PREVENTING SMOKE CURLING FROM UNDERNEATH THE HOOD OF A GREASE EXTRACTION VENTILATOR

[76] Inventor: Victor D. Molitor, 2829 S. Santa Fe Dr., Englewood, Colo. 80110

[21] Appl. No.: 730,600

[22] Filed: May 6, 1985

[51] Int. Cl.[4] ..... F24C 15/20

[52] U.S. Cl. ..... 126/299 R; 126/299 D; 126/299 E

[58] Field of Search ..... 126/299 R, 299 D, 299 C, 126/299 E, 300, 301, 21 R; 98/115.1, 115.3, 115.4; 55/DIG. 36

[56] References Cited

U.S. PATENT DOCUMENTS

| | | | |
|---|---|---|---|
| 399,430 | 3/1889 | Neef | 126/299 D |
| 3,941,039 | 3/1976 | Kinney | 126/299 D |
| 4,407,266 | 10/1983 | Molitor | 126/299 E |

FOREIGN PATENT DOCUMENTS

| | | | |
|---|---|---|---|
| 31554 | 3/1977 | Japan | 126/299 R |
| 75146 | 6/1980 | Japan | 126/299 D |

*Primary Examiner*—James C. Yeung
*Attorney, Agent, or Firm*—Horace B. Van Valkenburgh

[57] ABSTRACT

A method of preventing smoke curling from beneath depending enclosure walls of a grease extraction ventilator, comprises providing a series of apertures in the walls from adjacent the lower edge thereof for a predetermined distance upwardly. The apertures are preferably comparatively small and relatively closely spaced, being preferably placed in parallel rows, also parallel to the lower edge of the wall, with the apertures of adjacent rows. The number of rows may be varied, depending on the height of the wall and the capacity of the ventilator, with additional apertures for a ventilator having a larger capacity. The apertures may be slots, such as relatively short, and with the spacing between parallel rows being equal to or less than the height of the slots, with the lowest row being relatively close to the lower edge of the wall. Or, the apertures may be circular or having other shapes, such as oval, elliptical or the like. A device for preventing smoke rollout consists in apertures in the depending walls of an enclosure into which pass heated products of cooking, positioned as described in connection with the method.

22 Claims, 12 Drawing Figures

METHOD OF AND DEVICE FOR PREVENTING SMOKE CURLING FROM UNDERNEATH THE HOOD OF A GREASE EXTRACTION VENTILATOR

This invention relates to a method of and device for retarding or preventing the rollout or curling of smoke from underneath a hood or bonnet of a grease extraction ventilator.

BACKGROUND OF THE INVENTION

Numerous grease extraction ventilators have been developed, including those utilizing a water bath or water spray to assist in the removal of grease, smoke and the like, from heated air and products of cooking, as well as a dry type, in which heated air and products of cooking are passed through a body of mesh, such as retained between two screens. Normally, the bonnet or hood of a grease extraction ventilator comprises a series of depending walls which essentially surround an enclosure which is placed above the cooking equipment, so that heated air and products of cooking, rising from the cooking equipment, will collect in the bonnet and will flow toward the grease removal portion of the ventilator, then into a duct which extends to an exhaust fan or blower for exhausting the remaining air and gases, such as into the atmosphere. The exhaust fan produces a suction in the duct and draws the air and products of cooking through the grease removal means, which also may condense water vapor and remove small particles. All such ventilators have the problem, at times, of being flooded with smoke, as when a fire occurs, particularly on a broiler or other type of cooking equipment operating at higher temperatures. Normally, room air is drawn under the walls which surround the enclosure, which walls are normally the front and end walls, since the usual installation of a grease extraction ventilator is against a wall of a kitchen. However, there are some ventilators which have four walls exposed to the room and the method and device of this invention are equally applicable to such ventilators.

When an abnormal amount of smoke is produced, the smoke may tend to curl or roll underneath the lower edges of the enclosure walls and penetrate into the room. Often, such smoke carries cooking odors with it and may find its way into the dining area, which is often adjacent the kitchen, and become not only visually but also olfactorily disagreeable to the patrons. As far as is known, no success has met with attempts which have been made to cure this problem.

Among the objects of this invention are to provide a method of retarding or preventing the curling or rollout of smoke from beneath the edges of the depending walls which form an enclosure for receiving the products of cooking as well as room air; to provide such a method which is effective and efficient in overcoming this problem; to provide such a method which may be carried out with a minimum of expense; to provide a device which is particularly adapted to carry out the method of this invention; and to provide such a device which is readily and inexpensively incorporated in a grease extraction ventilator.

SUMMARY OF THE INVENTION

The method of preventing the curling or rollout of smoke from beneath the depending enclosure walls of a grease extraction ventilator, in accordance with this invention, comprises providing a series of apertures in the upright walls from adjacent the lower edge thereof for a predetermined distance upwardly. The apertures are preferably comparatively small and relatively closely spaced, being preferably placed in parallel rows, also parallel to the lower edge of the wall, with the apertures of one row alternating in position with the apertures of adjacent rows, in order to maintain as much strength as possible in the walls. The number of rows may be varied, depending on the height of the wall and the capacity of the ventilator, with additional apertures for a ventilator having a larger capacity.

The apertures may be slots, such as relatively short, and with the spacing between parallel rows being equal to or less than the height of the slots, with the lowest row being relatively close to the lower edge of the wall in which provided. However, the apertures may be circular or have any other shape, such as oval, elliptical or the like.

THE DRAWINGS

DESCRIPTION OF PREFERRED EMBODIMENTS

Figure 1:
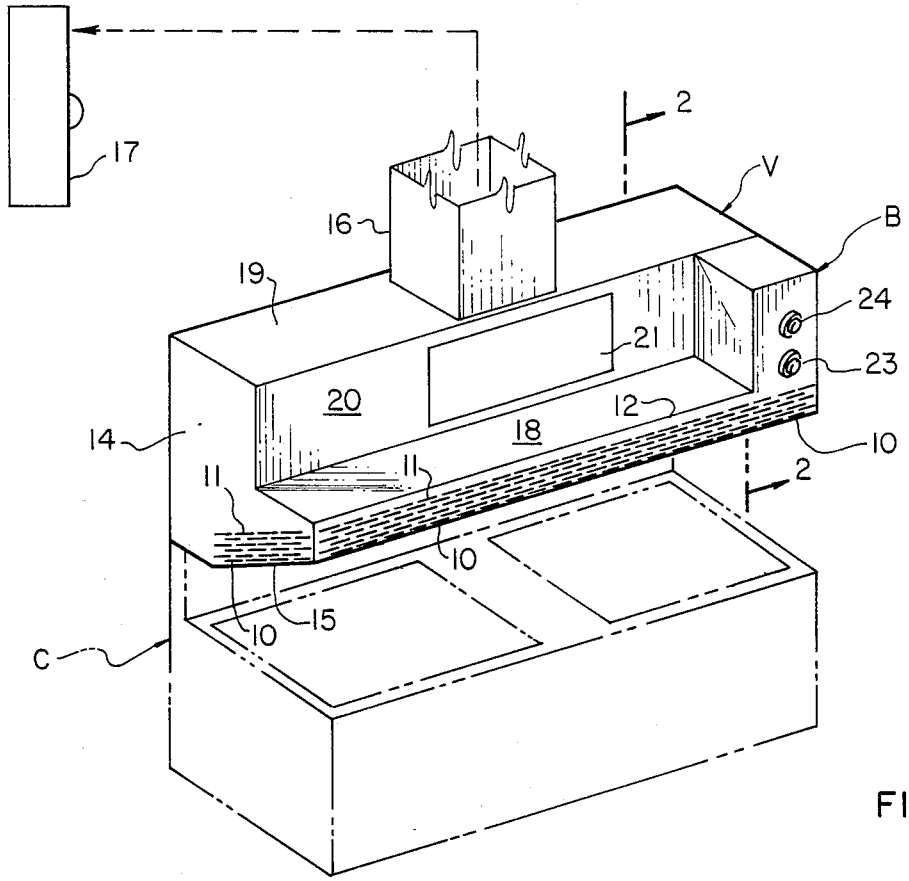
FIG. 1 is a perspective view of a grease extraction ventilator in which the method and device of this invention are utilized, showing also cooking equipment beneath the ventilator.
Figure 2:
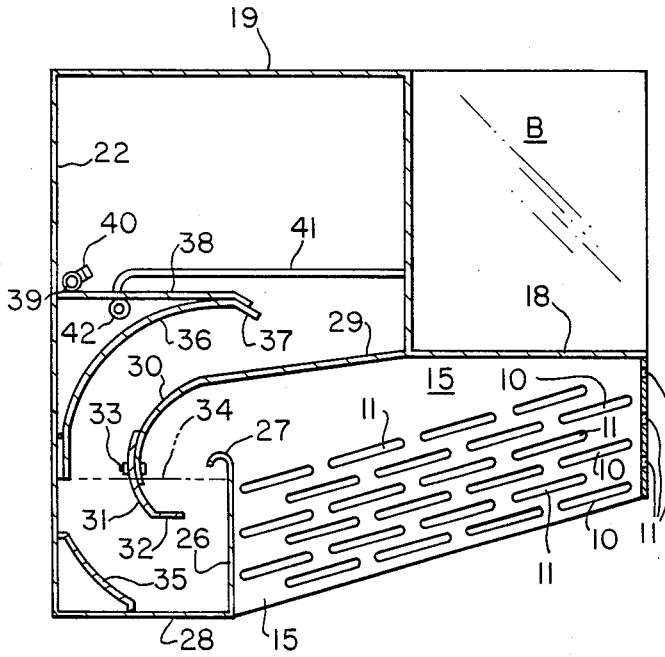
FIG. 2 is a vertical section, taken in the plane of lines 2—2 of FIG. 1.
Figure 3:
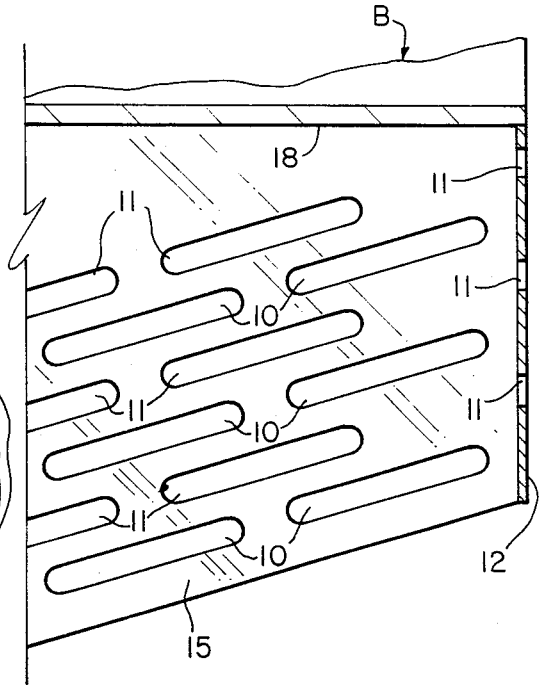
FIG. 3 is a fragmentary enlargement of a portion at the lower right of FIG. 2.

A smoke curl or rollout prevention method for a grease extraction ventilator to prevent or retard the curling or rollout of smoke from underneath the walls of a hood or bonnet of the ventilator into a room, may be utilized, as illustrated in FIGS. 1–3, to provide an appropriate number of rows of alternate slots 10 and 11, disposed just above and with each row essentially parallel to, the lower edges of each of the walls, panels or the like under which room air may be drawn to mix with heated air and products of cooking produced by cooking equipment C beneath the ventilator. Such walls of the ventilator V include a front depending flange 12, an extension 13 of one side wall 14, as in FIG. 1, and an extension 15 of the opposite side wall, as in FIGS. 2 and 3. Each of extensions 13 and 15 have an upwardly inclined lower edge. Rows of holes, circular or other shape, may be substituted for the rows of slots 10 and 11. The heated air and products of cooking move into the hood or bonnet, both by natural convection and suction by which the same are drawn upwardly through the ventilator and through a duct 16 extending, as indicated by the dotted line, to an exhaust fan 17 (shown in outline) at an appropriate location, as for discharge into the atmosphere.

The exhaust ventilator V of FIG. 1 is constructed similarly to the exhaust ventilator of U.S. Pat. No. 3,841,062, thus including a shelf 18 from which front flange 12 depends and a top plate 19 connects the end walls, as well as a front plate 20 having an access plate 21. The top plate 19 is also connected to a back plate 22 of FIG. 2, while exhaust duct 16 extends upwardly from top plate 19. A control box B, mounted on shelf 18, may be provided with a light switch 23 and a wash control switch 24 for turning on a washing mechanism, which will be referred to later.

The parts shown in FIG. 2 are essentially inside the ventilator and include a front plate 26 having a rearwardly extending curl 27 at the top, with plate 26 being connected to a bottom plate 28, which in turn extends rearwardly to the back plate 22. A fixed baffle 29 slopes downwardly above front plate 26 to a downwardly extending arcuate portion 30, while an adjustable baffle 31 having a front planar flange 32 is connected to arcuate portion 30 by bolts 33, to permit adjustment of the position of flange 32. Air and products of cooking are drawn between baffle 29 and curl 27, through suction produced by the discharge fan through duct 17, to engage a water bath which, prior to such engagement, extends upwardly to a dot-dash line 34 but is forced downwardly to pass under flange 32 and behind baffle 31, engaging a concave water deflector plate 35, whose rear edge is spaced slightly from back wall 20.

As the heated air and gases pass around flange 32, they will churn the water, causing tongues of water to move up into the air stream to remove grease as well as to condense vapor products. As the body of water is forced up against the deflector plate 35, it will overflow the upper rear edge and tend to carry grease and condensed vapor products with it, for collection beneath plate 32, in the lower portion of the body of water and later removal through drainage. The stream of air and heated gases will then move upwardly against an air deflector plate 36, which is provided with a slanting flange 37 at its upper edge and is stabilized by a series of brackets 38. Flange 37 tends to strip water droplets from the air passing around it, the droplets tending to fall onto the top of fixed baffle 29. From the space above flange 37, the mixed air and products of cooking, without the water and other condensable products which have been stripped by flange 37, pass into the duct 17 for discharge.

A hot water feed pipe 39 extends along the rear wall above brackets 38 and carries a series of nozzles 40 which spray hot water into the upper chamber against the rear of front wall 20 and the underside of top plate 19, as well as being deflected against the top of fixed baffle 29. One or more supply pipes 41 may extend to a manifold 42 below brackets 38, which carries a series of nozzles (not shown) for cleaning the upper side of air deflection plate 36.

The number of rows of slots may be varied, depending upon the size of the ventilator and also the amount of air normally drawn from the room in which the ventilator or a series of ventilators are installed. The speed of the conventional blower, by which air and products of cooking are removed through duct 16, may be controlled so that the suction is increased as the amount of heated products of cooking and room air increases, although it may happen that, even when the suction blower is operating at full capacity, the amount of heated products of cooking further increase and, at times, an undue amount of smoke is produced. At such times, there is a tendency for the heated gases carrying smoke to accumulate and expand, so as to curl under the lower edges of the hood, thereby carrying smoke and cooking odors into the room. Such smoke, and particularly cooking odors, tend to infiltrate into the dining areas, with a resultant distasteful effect on those partaking of food there.

It would normally be assumed, if smoke, such as carrying cooking odors, may curl out under the edges of the depending walls of the hood or bonnet, that the provision of a series of rows of apertures in each of the walls would cause the smoke to move outwardly from the hood at a more rapid rate and shortly permeate not only the kitchen but the entires premises. However, the reverse has been found to be true, since apparently the cooler air of the room, entering the apertures, will cool the more heated air inside the hood and, through contraction due to cooling, diminish the volume of the air and products of cooking, causing a decrease in the temperature and the volume of exhaust air, with the products of cooking flowing toward the inlet of the exhaust duct. Such decrease in volume apparently also increases the velocity with which the heated waste air rising from the cooking surfaces moves into the hood or bonnet, thereby producing an increase in the flow of air through the apertures in the outer walls of the ventilator and thereby eliminating the escape of waste heat, fumes and smoke into the room.

The slots 10 and 11 are placed in stagerred relation, in order to obtain maximum strength of the depending walls around the perimeter of the hood. The slots 10 and 11 may be on the order of 2 inches long, ¼ inch high and spaced apart in each row on the order of ½ inch, while the distance between rows may be on the order of ¼ inch. As shown, there are six rows of slots, although the number of rows and the number of apertures in each may be changed considerably.

Figure 4:
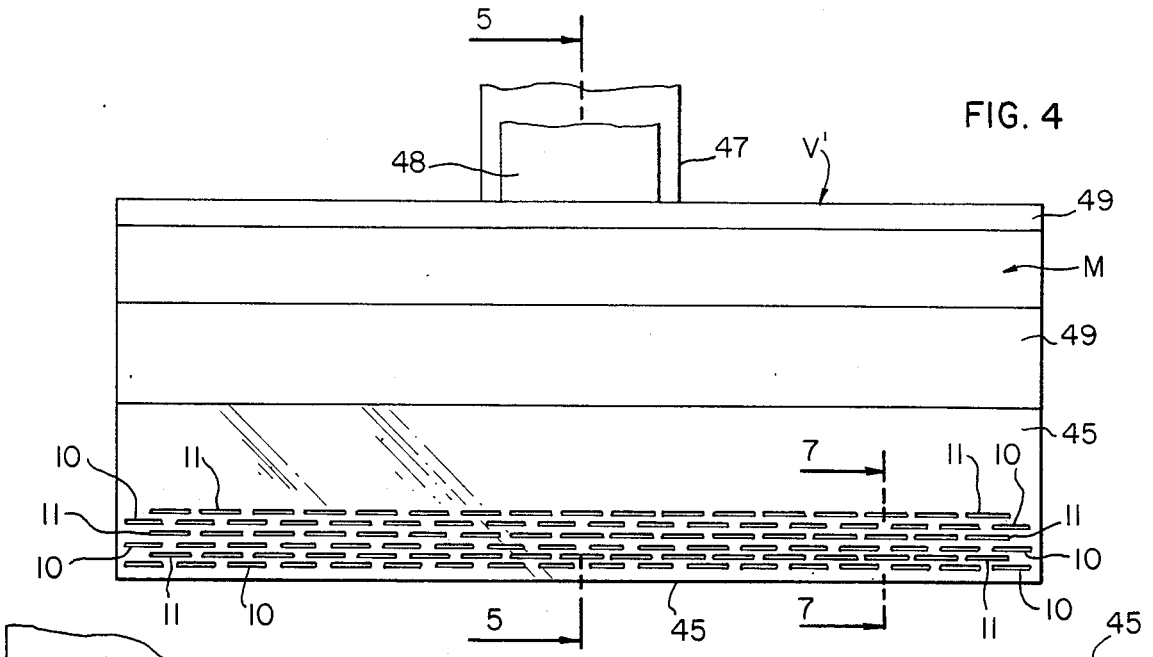
FIG. 4 is a front elevation of a grease extraction ventilator, capable of tempering incoming air for discharge into the room and also of bypassing a portion of the incoming air to a discharge duct.
Figure 6:
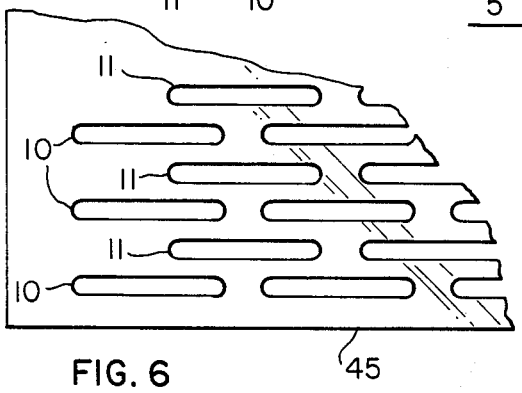
FIG. 6 is a fragmentary enlargement of a lower left portion of the ventilator of FIG. 4.
Figure 7:
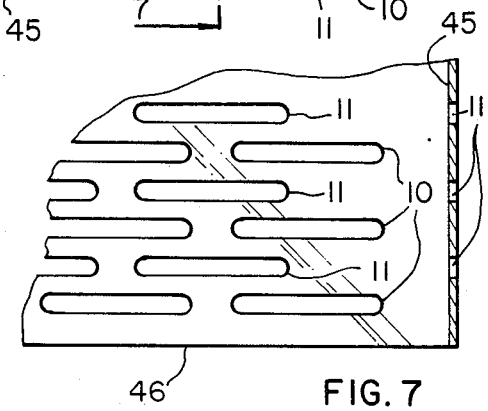
FIG. 7 is a fragmentary, enlarged vertical section, taken along line 7—7 of FIG. 4.
Figure 5:
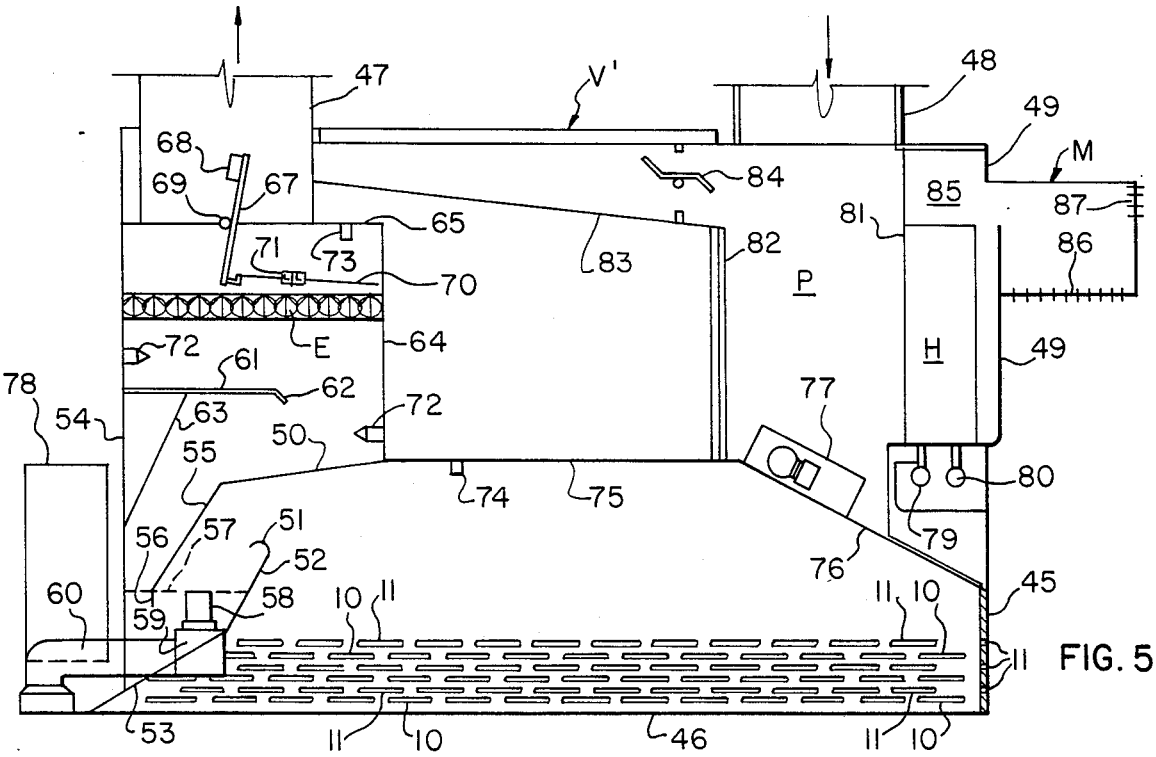
FIG. 5 is a vertical section, on an enlarged scale, taken along line 5—5 of FIG. 4.
Figure 8:
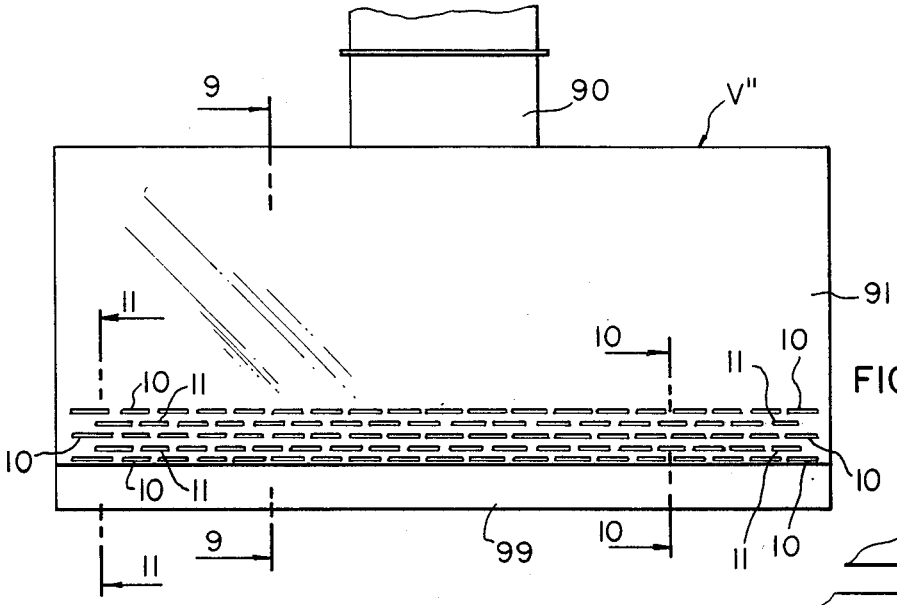
FIG. 8 is a front elevation of an additional type of ventilator in which the method and device of this invention are utilized.
Figure 10:
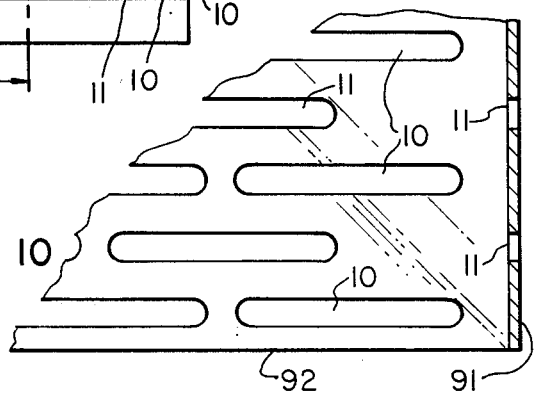
FIG. 10 is a fragmentary enlargement of a lower left portion of FIG. 9.

The method of preventing smoke curl of this invention may be applied to a ventilator V′ of FIG. 4, which may similarly be provided with a row of slots 10, interspaced and alternating with rows of slots 11, in a manner similar to ventilator V of FIG. 1. The rows of slots 10 and 11 are preferably placed in parallel relation to the lower edge of a lower front wall 45 of FIGS. 1 and 6, as well as an end wall 46 of FIGS. 5 and 7 and a corresponding end wall at the opposite end of front wall 45, i.e. having slots disposed in the same manner as end wall 45 in the lower portion thereof. The room air and heated air and products of cooking arising from the cooking equipment over which the ventilator is placed, in a manner similar to the ventilator V of FIG. 1, flow within the walls of the hood or bonnet, which include lower front wall 45, end wall 46 and the corresponding opposite end wall, to a device for removing grease and a discharge duct 47 of FIGS. 1 and 5, which leads to a conventional fan or blower (not shown) for exhaust of the air and gases into the atmosphere. The ventilator V' of FIGS. 4–7 is constructed similarly to the ventilator of U.S. Pat. No. 4,407,206, which is also adapted to temper fresh air in one or more heat exchangers and discharge the tempered fresh air into the room, as well as supply incoming air to the discharge duct in a manner which automatically regulates the amount of exhaust and makeup air required to remove and replace the minimal amount of outside air to eliminate heat, odors, smoke, gases, grease and dirt as the cooking load changes. As will be evident, even when the flow of makeup air to the exhaust duct 47, such as supplied from an air intake duct 48, is so regulated, there will be times during which the amount of smoke produced by the cooking equipment and the additional heat arising from the cooking equipment, due to the combustion which produces the smoke, may cause the temperature of the air and the products of cooking and combustion to increase sufficiently that its expansion prevents the exhaust duct and its fan or blower, even operating at maximum capacity, from removing all of the smoke from inside the hood, which then will cause the smoke to curl under the edges of the hood and flow into the room.

As indicated previously, it would be assumed that under such conditions, the provision of apertures at and adjacent the lower edges of the outer walls of the hood would permit even more smoke to pour into the room. However, as also indicated, the reverse will be true, since the flow of cooler air through the apertures 10 and 11 will tend to cool the products of cooking and combustion, thereby decreasing the volume of air and other gases within the hood and causing additional air to flow through the apertures and into the duct, as well as preventing any smoke from curling out from under the lower edges of the hood walls.

In addition to the walls 45 and 46, the exhaust duct 47 and air inlet duct 48, referred to above, the exterior of the ventilator, as in FIG. 4, includes an upper front wall 49 and a manifold M from which tempered air is discharged into the room. The interior of the ventilator V', as in FIG. 5, includes an upper inlet baffle 50, between which and a lip or curl 51 at the upper end of a front plate 52, flow the air and products of cooking and perhaps combustion, pulled by the exhaust fan out through exhaust duct 47. The lower edge of front plate 52 is connected to a bottom plate 53, which, in turn, is connected to a rear wall 54. The gases flow between front plate 52 and a downwardly extending baffle 55, which extends from inlet baffle 50 and has a depending flange or lip 56 at the bottom, around which the incoming gases drive the water of a water bath, which normally extends to a level indicated by the dotted line 57, but is driven rearwardly against the back wall 54. The normal level of water is determined by an overflow 58 connected to a base 59, in turn connected to an outlet 60.

In a manner similar to the ventilator V of FIG. 1, the gas stream will agitate the water and churn it up into tongues, thereby condensing vapors which are condensable, such as grease, then flow upwardly against a horizontal baffle 61 having a downwardly slanting lip or flange 62, which tends to strip droplets of water or other liquid from the gas stream, such droplets falling onto the top of upper entrance baffle 50 to flow back down into the water bath. Baffle 61 is supported by a series of spaced braces 63, while a front panel 64 and a top panel 65 complete the compartment into which the air and products of cooking flow. The latter, after being stripped of liquid droplets by flange 62, proceed upwardly to pass through a mist eliminator E, which is formed of woven or unwoven mesh, wire or the like, held by a pair of screens. Upward flow of these gaseous products continues into the discharge duct 47, past a fire damper 67 carrying a weight 68 and pivoted on a rod 69. The lower end of the damper is connected to a wire 70, which extends to front wall 64 and in which a fuse link 71 is interposed, so that if the temperature rises sufficiently to melt the fuse link, as the result of fire, the base of the damper will be released and the weight 68 will cause the damper to fall to a closed position. For cleaning purposes, a series of nozzles 72 may be mounted at appropriate positions on the rear wall 54 and the front wall 64, to spray the front wall and the top of baffle 61, as well as the bottom of baffle 61, the rear wall 54 below baffle 61 and the top of baffle 50. This will tend to clean any collected grease off the interior walls of the compartment through which the air and products of cooking flow.

A principal temperature control device 73 may be mounted adjacent the intake of exhaust duct 47 and a secondary tempereature responsive control device 74 on the underside of a panel 75, which extends forwardly from baffle 50, so as to be responsive respectively to the temperature of exhaust gases just prior to entering the exhaust duct and the temperature of the exhaust gases just prior to flowing into the grease removal compartment of the grease extraction ventilator. A panel 76 may extend from panel 75 to lower front wall 45 to complete the open bottomed enclosure in which air and products of cooking are collected for flow into the ventilator. A light 77 may be installed above panel 76, to illuminate the enclosure. A pump and motor 78, illustrated diagrammatically, transfer the water of the water bath, heated by flow of heated gases therethrough, to a series of heat exchangers H and supplied by a header 79, with return flow through a header 80 to the water bath. The normally fresh air supplied to air intake duct 48 passes into a plenum chamber P flanked by a front wall 81 and an insulated rear wall 82. A bypass duct 83 extends between chamber P and the exhaust duct 47, with a pivotally mounted damper 84 controlling the flow from plenum chamber P to exhaust duct 47. The control will increase the flow of bypass air when the temperature at primary control device 73 decreases and will decrease the flow of bypass air when the temperature at the primary control device increases. The secondary control device 74 may be utilized to increase or decrease the flow of bypass air when the temperature at control device 73 has not changed but the temperature at control device 74 suddenly increases or decreases. In other words, the control device 74 is utilized to anticipate a change in temperature at control device 73, which has not yet reached it. The water transferred by pump 78 to the heat exchangers H through which the air from plenum chamber P flows into an outer compartment 85, will be heated in the winter time, since the water through which the heated air and products of cooking flow, will normally be heated to a temperature higher than that of outside air. However, during the summer time, when the outside air temperature is higher than the temperature of the water bath, the incoming air will be cooled. The air thus tempered flows into the manifold M and is discharged into the room, through bottom louvres 86, downwardly alongside the upper front wall 49 and the lower front wall 45, while additional tempered air will flow through upper louvres 87 for discharge along the ceiling of the room. Air which flows through louvres 86 may flow into the room, or into the hood through slots 10 and 11 or underneath the lower edge of the lower front wall 45.

The method of this invention may also be applied to a ventilator having a so-called "dry" type of filter, such as the ventilator V" of FIGS. 8–11 having a filter F of the mesh type through which the heated gases and products of cooking pass from the cooking equipment for entrapment of smoke particles, moisture or the like, to an exhaust duct 90. The ventilator V", in accordance with this invention, is provided with a series of slots 10 disposed in parallel rows, alternating with slots 11 disposed in parallel rows, above the lower edges of a front wall 91, as in FIGS. 8 and 10, an end wall 92, as in FIGS. 9 and 10, and an opposite end wall 93, as in FIG. 11. The heated products of cooking, as well as some room air, pass into the bonnet surrounded on three sides by walls 91, 92 and 93, for passage through filter F to exhaust duct 90 in the direction of the arrows of FIG. 9, drawn by a conventional exhaust blower (not shown) disposed at an appropriate position at the end of duct 90. The slots 10 and 11, in the respective walls, as before, act to permit the flow of cooler room air through the slots into the bonnet for cooling heated gases and thereby causing the volume to decrease and the cooler gases to flow more readily through filter F to the exhaust duct 90, thereby avoiding the curling of smoke around the underside of front wall 91 or end wall 92 or 93 when the production of heated gases and smoke is greater than the exhaust blower can accommodate.

Ventilator V" is provided with a top wall 94 and a rear wall 95, and also a rearwardly and downwardly slanting upper partition 96 for filter F, as well as a downwardly and forwardly slanting bottom panel 97. Filter F, or a series of filters in side-by-side relation, are received in brackets mounted on the lower edge of upper partition 96 and the upper edge of a series of rearwardly and downwardly slanting drain tubes 98, which collect liquid draining from the filters F and transfer the same to a catch basis 99. Ordinarily, the ventilator V" is installed against a wall and, for this purpose, a rear panel 100, at each end, may cover the space between rear wall 95 of the ventilator and the room wall 101.

Figure 12:
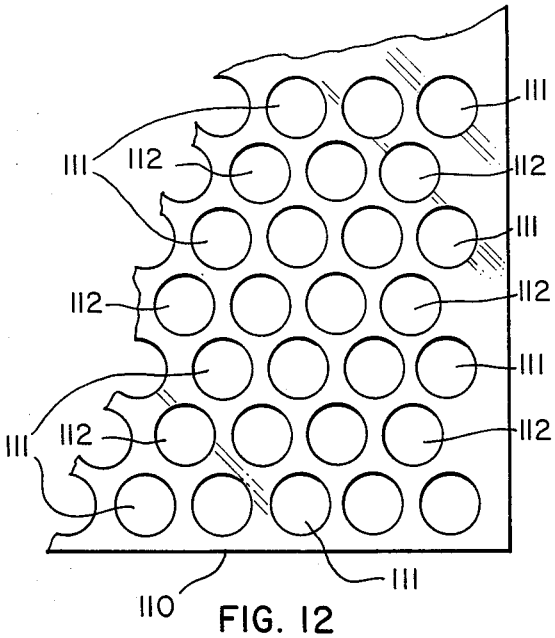
FIG. 12 is a fragmentary elevation of a lower corner of a front wall of a grease extraction ventilator, in which the method and device of this invention are utilized and showing, on a further enlarged scale, a variation in the apertures.

Variations of the smoke curling prevention apertures of this invention may be utilized, including differences in the apertures and application to various types of grease extraction ventilators, in addition to those illustrated. One variation in the apertures is shown in FIG. 12, in which a panel 110, which may be a front, side, end or other depending panel of a grease extraction ventilator, is provided with a series of circular holes 111, which are disposed in spaced relation in parallel rows and in offset or alternating relation to a series of holes 112, which are generally spaced apart in parallel rows interspaced with the rows of holes 111. It will be noted that the holes 111 and 112 may be oval, rectangular, square, triangular, diamond-shaped, elliptical, trapezoidal, or of any other geometric configuration. In each instance, the particular shape of the holes does not matter, except that an arrangement of holes should be provided which causes adequate strength to be retained in the panel or wall in which the holes are placed.

Figure 11:
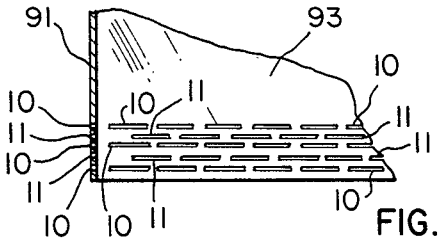
FIG. 11 is a fragmentary, vertical section, taken along line 11—11 of FIG. 8.
Figure 9:
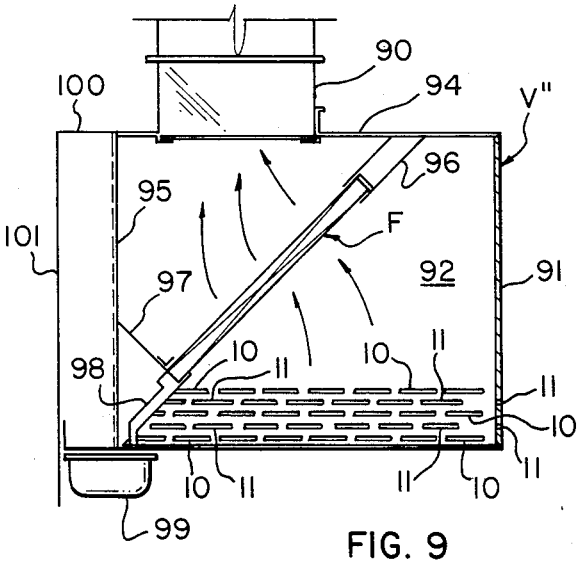
FIG. 9 is a vertical section, taken along line 9—9 of FIG. 8.

In the case of the circular holes of FIG. 11, for instance, the holes may have a diameter of $\frac{3}{8}$ inch and be spaced apart, in each row, on the order of $\frac{1}{8}$ inch, with the distance between diagonally related holes in adjacent rows being on the order of $\frac{1}{8}$ inch. The holes, of course, may follow a different configuration and be straight in line, while when in parallel rows, the rows may extend at different angles to the edge of the panel in which placed. It is desirable, of course, to maintain as many holes as possible fairly close to the lower edge of each panel in the wall in which placed, with the distance between and relative placement of the holes involving a consideration of the strength of the resultant structure and its ability to withstand the stresses to which the walls of the ventilator would be subjected.

It is noted that the embodiment of FIGS. 1–3 and FIGS. 4–7 are shown with six rows of apertures, while the embodiment of FIGS. 8–11 is shown with five rows of apertures and the variation of FIG. 12 is shown with seven rows of apertures. It will thus be understood that any desired number of rows, as well as other arrangements of the apertures, may be utilized.

It will further be understood that, although several embodiments and variations of the type of grease extraction ventilator to which the principles of this invention may be applied, have been illustrated and described, other embodiments may exist and the principles applied to other types of grease extraction ventilators without departing from the spirit and scope of this invention.

What is claimed is:

1. A method of preventing smoke curling from beneath a hood of a grease extraction ventilator installed in a room above cooking equipment and having depending walls including a front wall and end walls essentially surrounding an enclosure into which pass heated air and products of cooking, then through means for removing water, grease and other products of cooking, to an exhaust duct to which suction is applied, comprising:

providing a series of apertures in at least the lower portion of said front wall from adjacent the lower edge thereof for a predetermined distance upwardly, said apertures being comparatively small and relatively closely spaced, whereby room air passes through said apertures into said enclosure.

2. A method as defined in claim 1, which includes:

providing a series of apertures in rows with apertures of one row alternating in position with apertures in adjacent rows.

3. A method as defined in claim 2, which includes:

providing said rows in parallel relation to said lower edge of the corresponding wall.

4. A method as defined in claim 3, which includes:

providing apertures having a shape selected from slots and circular holes.

5. A method as defined in claim 4, which includes:

spacing the rows so that the distance between the nearest edges of apertures in adjacent rows is not more than the height of the apertures.

6. A method as defined in claim 1, wherein:

a sufficient volume of air at a sufficiently low temperature flows through said apertures from said room to cool a sufficient amount of heated air and products of combustion within said enclosure so that the volume of gases within said enclosure is decreased and the velocity of flow to said exhaust duct is increased.

7. A method as defined in claim 1, including:

providing at least the lower portion of each said end wall with said apertures.

8. A method as defined in claim 1 including:

positioning the lower of said apertures relatively closely adjacent to the lower edge of said wall.

9. A device for perventing smoke curling from beneath a hood of a grease extraction ventilator installed in a room above cooking equipment and having depending walls including a front wall and end wall essentially surrounding an enclosure into which pass heated air and products of cooking, then through means for removing water, grease and other products of cooking, to an exhaust duct to which suction is applied, comprising:

a series of apertures in at least the lower portion of said fron wall from adjacent the lower edge thereof for a predetermined distance upwardly, said apertures being comparatively small and relatively closely spaced, whereby room air passes through said apertures into said enclosure.

10. A device as defined in claim 9, which includes:

a series of apertures in rows with apertures of one row alternating in position with apertures in adjacent rows.

11. A device as defined in claim 10, wherein:

said rows are in parallel relation to said lower edge of the corresponding wall.

12. A device as defined in claim 11, wherein:

said apertures have a shape selected from slots and circular holes.

13. A device as defined in claim 11, wherein:

said rows are spaced whereby the distance between the nearest edges of apertures in adjacent rows is not more than the height of the apertures.

14. A device as defined in claim 7, wherein:

said apertures are sufficient in total area to permit a flow through said apertures of a sufficient volume of air at a sufficiently low temperature to cool a sufficient amount of heated air and products of combustion within said enclosure so that the volume of gases within said enclosures is decreased and the velocity of flow to said exhaust duct is increased.

15. A device as defined in claim 9, wherein:

said walls provided with said apertures include at least the lower portion of said depending end walls.

16. A device as defined in claim 15, wherein:

the lower edges of said end walls slant upwardly; and said apertures are disposed in rows parallel to said lower edges.

17. A device as defined in claim 9, wherein:

said grease extraction ventilator is provided with dry means for removing products of cooking.

18. A device as defined in claim 9, wherein:

said grease extraction ventilator is provided with water means for removing products of cooking.

19. A device as defined in claim 18, wherein:

said water means for removing products of cooking includes a water bath;

said grease extraction ventilator is provided with means for tempering makeup air for a room in which installed, through heat exchange with water of said water bath; and means for discharging said makeup air into said room, including means for discharging makeup air downwardly along said depending front wall.

20. A device as defined in claim 15, including:

means for discharging makeup air for said room downwardly along at least one of said walls.

21. A device as defined in claim 9, wherein:

said ventilator is provided with means for receiving makeup air and discharging a portion thereof into the room in which installed;

means for bypassing a portion of said makeup air to said exhaust duct; and means for controlling the amount of air bypassed to said exhaust duct inversely in accordance with the temperature of the exhaust gases.

22. A device as defined in claim 9, wherein:

the lower of said apertures are positioned relatively closely adjacent to the lower edge of said wall.

* * * * *